US005599018A

United States Patent [19]

Radel

[11] Patent Number: 5,599,018

[45] Date of Patent: Feb. 4, 1997

[54] STRUNG RACKET

[76] Inventor: Harry Radel, Uhrbrook 27 b, D-21502, Geesthacht, Germany

[21] Appl. No.: 412,284

[22] Filed: Mar. 28, 1995

[30] Foreign Application Priority Data

Mar. 31, 1994 [DE] Germany ..... 9405479 U
Aug. 25, 1994 [DE] Germany ..... 9413688 U

[51] Int. Cl.[6] ..... A63B 49/02
[52] U.S. Cl. ..... 473/521
[58] Field of Search ..... 273/73 R, 73 C, 273/73 D, 73 G

[56] References Cited

U.S. PATENT DOCUMENTS

| | | | |
|---|---|---|---|
| 4,042,238 | 8/1977 | Theriault | 273/73 G X |
| 4,811,947 | 3/1989 | Takatsuka et al. | 273/73 G X |
| 4,828,259 | 5/1989 | Davis | 273/73 G X |
| 4,976,433 | 12/1990 | Pohlenz et al. | 273/73 G X |
| 4,988,101 | 1/1991 | Soong | 273/73 G X |
| 5,133,552 | 7/1992 | Feeney et al. | 273/73 G |
| 5,249,799 | 10/1993 | Chang | 273/73 G |
| 5,282,617 | 2/1994 | Hong | 273/73 G |
| 5,340,102 | 8/1994 | Adamson | 273/29 A |
| 5,423,533 | 6/1995 | Hsu | 273/73 G X |

FOREIGN PATENT DOCUMENTS

| | | | |
|---|---|---|---|
| 0032506 | 3/1984 | European Pat. Off. . | |
| 0171033 | 2/1986 | European Pat. Off. . | |
| 0275805B1 | 8/1991 | European Pat. Off. . | |
| 886136 | 6/1943 | France | 273/73 G |
| 2225539 | 6/1990 | United Kingdom . | |
| 2225537 | 6/1990 | United Kingdom . | |
| 2226250 | 6/1990 | United Kingdom | 273/73 G |

*Primary Examiner*—William E. Stoll
*Attorney, Agent, or Firm*—Kelly, Bauersfeld & Lowry

[57] ABSTRACT

In order to provide a racket with strung netting, more particularly a tennis or squash racket, comprising a frame (10) which delimits a striking area (11) formed by strings tautly strung in the frame (10), a handle (14) as well as a connection piece (13) connecting the handle (14) with the frame (10), wherein, within the region of the racket (100), in which the racket (100) undergoes a strong deflection when striking, a resiliently mounted addition material (16) is fitted, in which these undesirable effects are, at low costs, either very largely eliminated or at least substantially reduced and wherein the striking properties are improved at the same time, it is proposed that the addition material (16) be configured in a rod-like fashion, that the addition material be disposed with its rod axis at a right angle to the handle axis and so as to lie in the plane defined by the striking surface (11).

21 Claims, 4 Drawing Sheets

STRUNG RACKET

The present invention relates to a racket with strung netting, comprising an open frame delimiting a striking area formed by stings tautly strung in the frame, a handle as well as a connecting piece connecting the handle with the frame, wherein, within the region of the racket in which the racket undergoes a strong deflection when the ball is struck, a resiliently mounted addition or filler material is fitted.

BACKGROUND OF THE INVENTION

Such a racket is known e.g. in the form of a tennis racket from the DE-B2-25 64 028.

Rackets of the known type possess, within the striking surface, an area determined by the geometry of the frame and the tautness of the strings, the so-called "sweet spot". If in the course of the striking, the ball strikes within this area, it can be controlled and played in a reliable manner, in which case the deflections of the vibration system formed by arm, hand and racket and, with that, the strain on the arm and the hand of the player is comparatively light.

However, the conditions are different when the ball impinges upon the striking surface outside the sweet spot. If the point of impact diverges in the longitudinal axis of the racket from the sweet spot, strong flexural vibrations are started up in the arm-hand-racket system which impair the feel for the ball and the control of the ball and stress the player more strongly. If the point of impingement diverges laterally, i.e. transversally to the longitudinal axis of the racket, torsional vibrations are produced which are connected with the pertinent negative repercussions.

In order to reduce or avoid the vibrations of the racket which have a negative effect, many diversely constructed vibration damping systems have already been developed.

Thus, from the DE-A-27 21 715, a damping system for tennis rackets is known which is accommodated in the hollow frame of the racket and which is essentially comprised of a cord or a wire which, by way of example, is enclosed inside the hollow racket frame in a resilient embedment.

Furthermore, from the publications U.S. Pat. No. 4,948,131, GB 2,225,539 A, EP 171 033 A3 and the EP 32 306 B1, cylindrical vibration damping elements are known which are inserted into the frame vertically to the racket surface and which are, in part, also resiliently mounted.

Cylindrical damping elements which are mounted in other spatial directions in or on the frame, are likewise known from the EP 32 506 A1 and the GB 2,225,537 A.

Occasionally, also different solution proposals are to be found, as in the DE-A-23 38 534, in which damping elements are disclosed which are comprised of a material attached to an elastic pin that is provided on or in the handle, or of an elastic strand which is bent in the manner of a "U" and, inter alia, which is disposed in the triangle between racket and handle in such a way that the legs of the "U" are secured to the frame, while the bent portion is able to swing freely.

According to the EP 275 805 B1, tennis rackets also form part of the state of the art in which, between handle and striking surface, plates coated with an elastic material are fitted to the frame so as to damp vibrations.

However, these damping means have proved themselves to be disadvantageous for a number of reasons.

The known vibration damping systems compensate flexural vibrations only to an inadequate extent since the damping materials, by virtue of their disposition in the space relative to the racket, are able to execute corresponding compensatory vibrations only inadequately.

The damping devices likewise impose a strain on the striking hand by their additional weight, which makes itself clearly felt when playing over a longer period of time without it being possible to profitably make use of the additional weight for the stroke.

In addition, for almost all damping systems, structural steps are necessary on the racket frames which, in part, are very expensive so that relevant frame constructions have to be developed first which forces the production costs up unnecessarily and, moreover, very largely rule out a refitting of rackets already fabricated.

That is why it is the technical problem of the present invention to provide a racket of the type stated in the beginning, in which these undesirable effects are either eliminated to a large extent or at least greatly reduced at a modest cost, while the striking properties are improved at the same time.

The technical problem is resolved by means of the features characterized in the claim 1.

SUMMARY OF THE INVENTION

The central idea consists in that at at least one characterized spot of the racket, a damped, springably mounted addition or filler material is disposed, in which case the addition or filler material is configured in a rod-like fashion and, with its rod axis, is secured at a right angle to the handle axis on the frame.

In a first preferred embodiment of the racket according to the invention, the addition material is disposed within an area of the racket wherein the racket undergoes a strong deflection in the course of the striking, more particularly within the region of the connection piece between frame and handle. Sufficient space exists in this region for accommodating the addition material without any problems and without it being necessary to modify the racket configuration.

A second preferred embodiment of the racket is distinguished in that the addition material is embedded in a resilient damping material and in that a foamed plastic or cellular rubber is employed as damping material. Addition material and damping material are embedded in a vibration eliminating chamber possessing solid walls so as to obtain a stable unit which can be mounted on the racket. A particularly simple and operationally reliable, damped springable mounting of the addition material is realized hereby.

By means of the special construction and disposition of the addition material, flexural and, more particularly, torsional vibrations are damped. In addition, by means of the resilient mounting of the addition material, which permits a displacement of the material in the direction of the racket surface when the stroke is executed, the power of the stroke is clearly increased by the additional weight.

When flexural vibrations of the frame occur, by the inertia of the addition material, a force is generated between material and frame which, in the first vibration stage or phase, contributes to the acceleration of the ball and compresses the cellular rubber. Since the decompression time of the cellular rubber is greater than a vibration stage or phase of the frame, the cellular rubber remains in a partialyl compressed state when a post-impact vibration of the frame takes place in the case of hits outside the sweet spot. By means of the hollow spaces forming in the direction of the acceleration between the compressed cellular rubber and the vibration eliminating chamber containing the addition material and the cellular rubber, during the post-impact vibration of the racket frame, an almost undamped momentum interchange between the frame and the addition material moving in the opposite direction takes place at the moment of impact. In the case of ball contact within the upper region of the racket surface, following the first swinging through of the racket frame necessary for the feel of the ball, a suppression of the post-impact vibrations occurs. Through this it becomes possible to use a "soft" frame, which is positive for the feel of the ball without having to put up with the known disadvantages caused by vibrations.

In this connection, an addition material of approximately 10 g has proved itself, it being possible, however, for deviations to be necessary in accordance with each type of racket used.

The use of foamed plastic or of cellular rubber possessing an elastic recovery behavior in excess of 7 ms has proved itself to be especially advantageous.

BRIEF DESCRIPTION OF THE DRAWINGS

In the following the invention will be explained in greater detail with the aid of an embodiment example in connection with the figures. Thus

DETAILED DESCRIPTION OF THE PREFERRED EMBODIMENT

Figure 1:
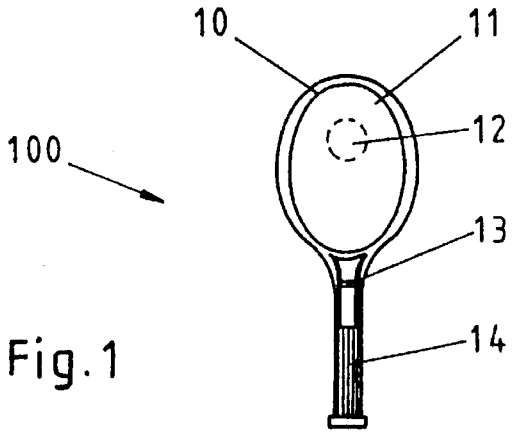
FIG. 1 shows the construction of a conventional racket in an overall view.

In FIG. 1, the construction in principle of a racket 100, from which the invention sets out, is depicted in an overall view. The racket comprises a circular, oval or similarly configured frame 10. Through pertinent holes in the frame 10, (non-depicted) strings are strung and tautened, which intersect in a reticular fashion in the striking surface 11 bounded by the frame. The racket further comprises an oblong handle 14, which is rigidly connected to the frame 10 by means of a connection piece 13. Frame 10, handle 14 and connection piece 13 can be comprised of wood, metal or of a fiber-reinforced plastic.

In the center of the striking surface 11—independently of the geometry of the frame and the stringing—the so-called "soft spot" 12 is located (indicated dotted in FIG. 1). If the ball hits upon the striking surface within this region or if the ball is hit by this region of the striking surface when the player delivers a stroke, the racket acts very largely in a "neutral" manner, i.e. the vibration tendency of the vibration system formed of arm, hand and racket, is slight. When the stroke is executed, the ball can be controlled well, the player has the requisite feel for the ball and the physical strain the player is subjected to is normal. If, on the other hand, the ball impacts upon the striking surface 11 outside the sweet spot 12, depending upon the place of impingement, flexural or torsional vibrations are started up which detract from the feel for the ball, render the control of the ball difficult and additionally stress the player physically. In order to reduce or eliminate these disadvantages, the invention proposes to mount an addition material in a damped springable manner on the racket, which cuts down this vibration tendency. In principle it is possible to mount the addition material at the point of the racket 100 located opposite the handle 14. However, a placing is preferred which can be gathered from FIG. 2.

Figure 2A:
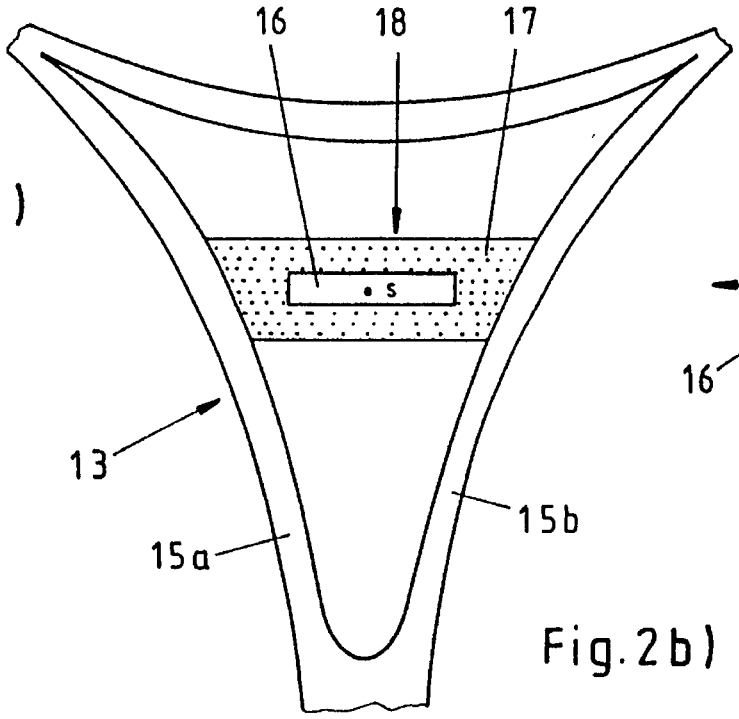
FIGS. 2(*a–c*) show, in a detailed view, an embodiment example of a racket according to the invention with an addition material in the connection piece between frame and handle in a view from the top (*a*), in a side view (*b*) and in section transversally to the racket axis (*c*)
Figure 2B:
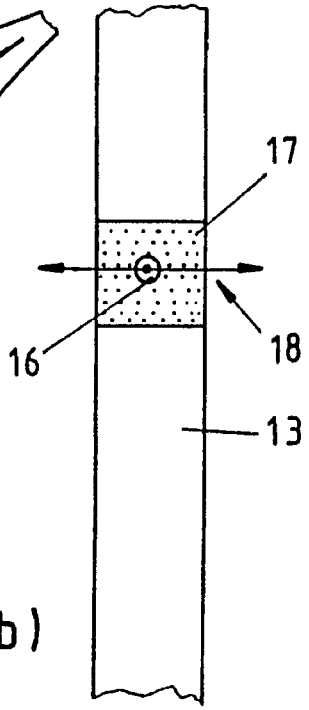
Figure 2C:
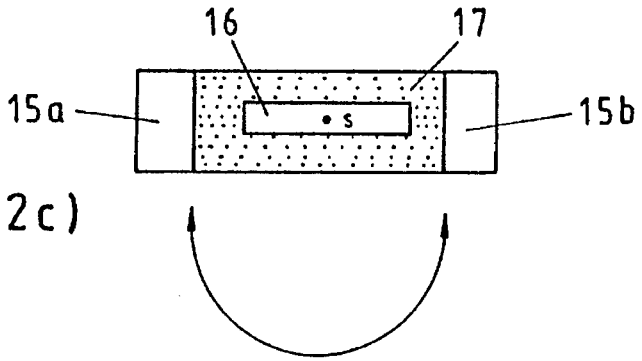

From the detailed view of the connection piece 13 reproduced from the FIG. 2 it can be discerned that an addition material 16 is provided between the bifurcating supporting struts 15*a, b*. The addition material 16 is embedded in an elastic damping material 17, preferably connected together by gluing or by vulcanization, in order to achieve the damped springable mounting accoring to the invention. The use of cellular rubber with a core of sintered tungsten possessing a density of approximately 18 g/cm$^3$ as a damping material has proved to produce a good vibration cushioning function. The addition material 16 and the damping material 17 are in turn embedded in a vibration eleiminating chamber 18 which, with the aid of non-depicted fastening means, is secured to the connection piece 13. The chamber may be formed by the frame itself. In the case of a mono-racket (i.e., where the handle is directly connected to the striking surface without the frog), the vibration eliminating chamber is disposed longitudinally to the handle axis within the point of balance underneath the striking surface. As an additional component, the chamber may be formed of carbon fiber material with a positive connection to the frame secured by means of tape. In this manner, the addition material may be ensheathed with cellular rubber and inserted with prestress into the cushioning chamber, with a 10% prestress with respect to both diameter and length. In the damping material 17 embedment, the addition material, in the event of rapid deflections of the racket occurring, is able to move in relation to the racket and this both in a linear as well as in a rotary movement. However, on account of the damping properties of the damping material 17, this relative motion is damped immediately. With this there results altogether a damping of the vibration system arm-hand-racket, which leads to an improved control of the ball and a reduction of the physical strain.

As is clearly discernible from the top view of the FIG. 2(*a*), the addition material 16 is preferably configured in a rod-like fashion. It is, in the damping material 17, disposed with its rod axis transversally to the handle axis and lying in the plane defined by the striking surface 11. Due to the rod-like configuration of the addition material 16 and the disposition transversally to the direction of the stroke, this system acts upon flexural vibrations as indicated in FIG. 2(*b*) by the double arrow. Over and above that, the addition material 16 possesses the additional effect that the acceleration of the ball is improved when striking because the addition material acts as an energy reservoir at the moment when the stroke is executed.

In the FIG. 3*a–e*, the vibration eliminating chamber 18 is depicted in a section so that the position of the addition material 16 is discernible in the individual phases of a stroke, as is also the deformation of the damping material 17.

Figure 3A:
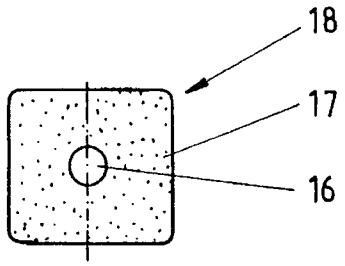
FIG. 3*a–e* shows, in a sectional side view, the vibration eliminating chamber in different states of vibration.
Figure 3B:
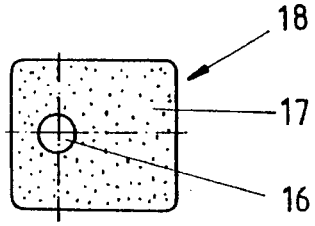
Figure 3C:
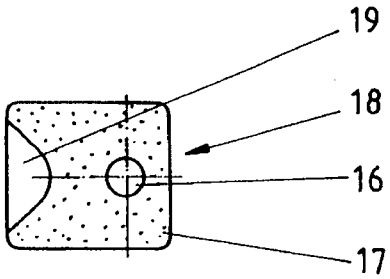
Figure 3D:
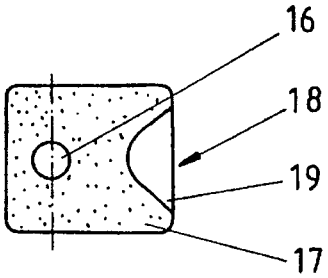
Figure 3E:
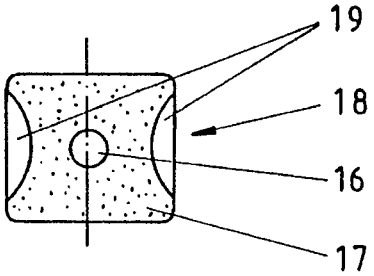

FIG. 3*a* shows the vibration eliminating chamber 18 in the rest position. In the FIG. 3*b*, the displacement of the addition material 16 inside the vibration eliminating chamber 18 up to the stroke is depicted up to the execution of the stroke. Subsequent to the effected stroke, the addition material 16 (FIG. 3*c*) vibrates back, in which process the damping material 17 remains in a partially compressed state since the decompression time of the damping material 17 is greater than a vibration phase or period of the frame 10. During the oppositely directed vibration in FIG. 3*d*, an almost undamped momentum interchange takes place, more particularly through the formed hollow spaces 19 so that the frame vibrations are damped. In the FIG. 3*e*, the rest position shown in the FIG. 3*a* is reestablished, while the hollow spaces 19 remain for the time being.

Figure 4A:
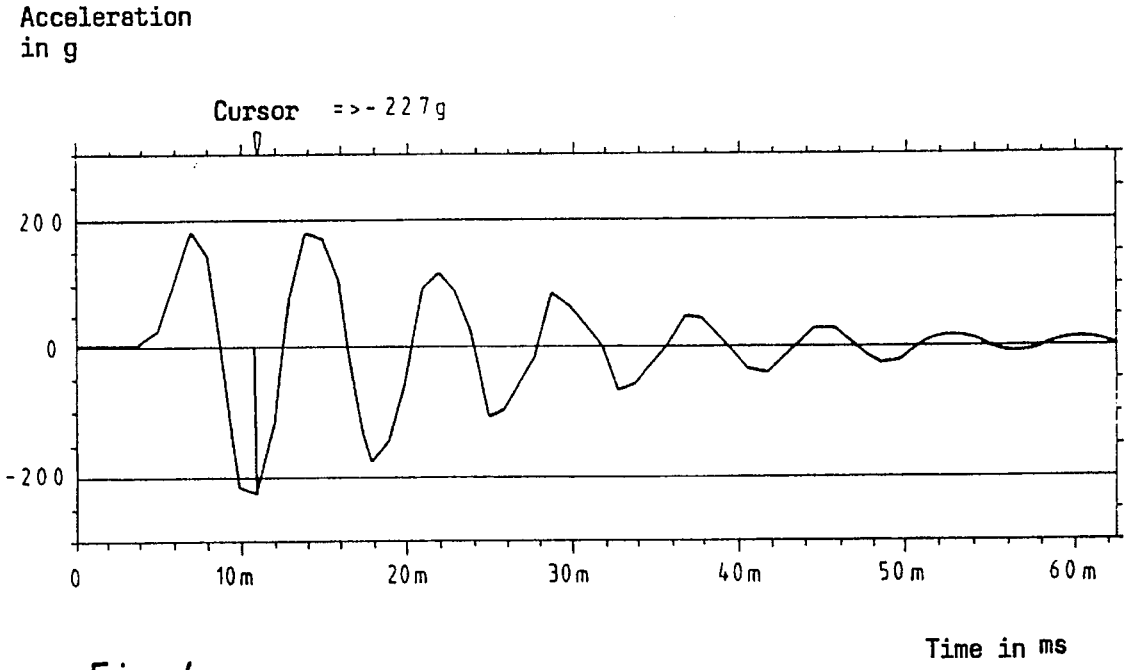
FIG. 4*a* shows a diagram illustrating the vibration amplitude in g (acceleration due to gravity) in dependence upon the time in ms of the racket-arm system without damper.
Figure 4B:
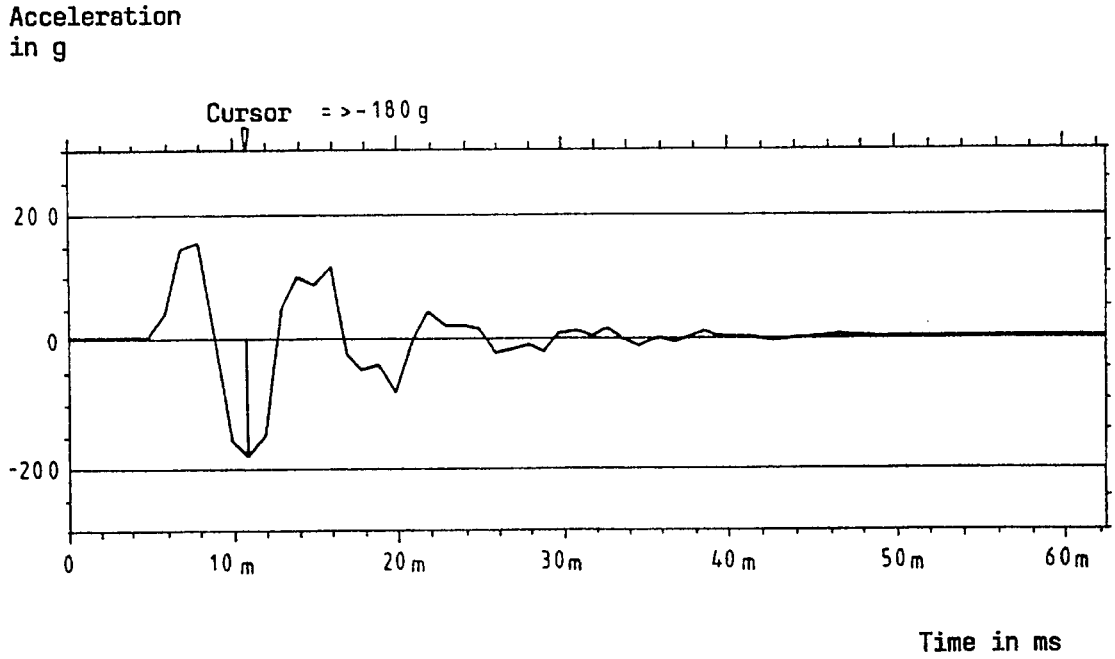
FIG. 4*b* shows a diagram illustrating the vibration amplitude in g (acceleration due to gravity) in dependence upon the time in ms of the racket-arm system with damper.

The FIGS. 4*a* and *b* each show in a diagram the vibration curve after a stroke, it being clearly discernible in this case that the use of the vibration eliminating chamber 18 (FIG. 4*b*) imparts a strongly damped characteristic to the curve. Already after 20 ms, the vibrations have gone down to a tolerable degree, whereas in the undamped system, at 20 ms, a force is still acting upon the racket handle, which corresponds to the force which occurs in the damped system at the time of the stroke itself.

Figure 5A:
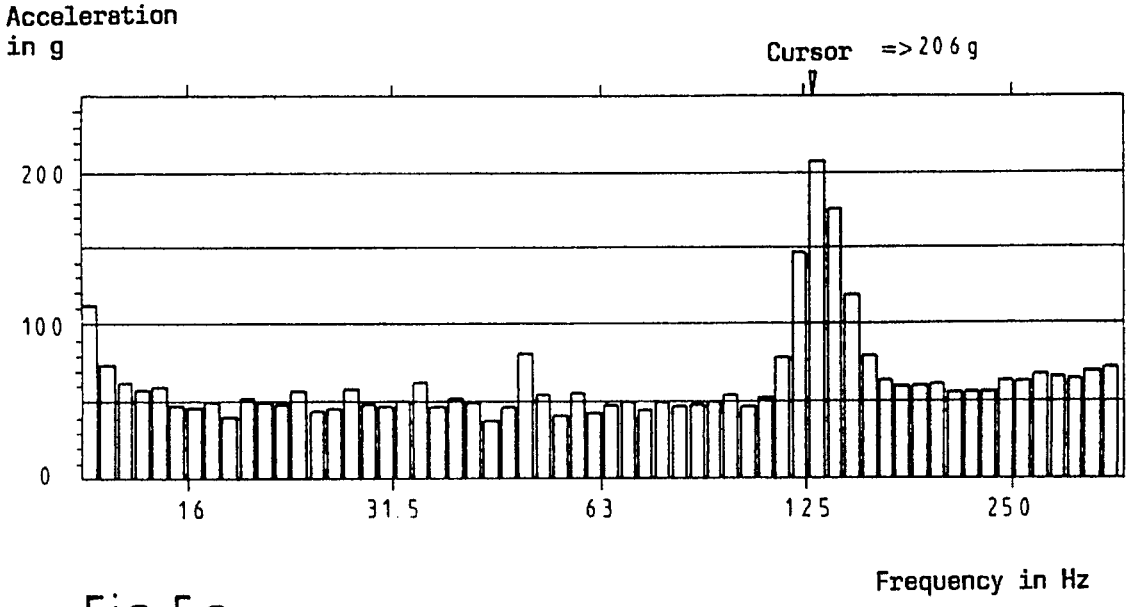
FIG. 5*a* shows a vibration spectrum, in which the vibration amplitude is illustrated in g (acceleration due to gravity) in dependence upon the frequency of the racket-arm system without damper.
Figure 5B:
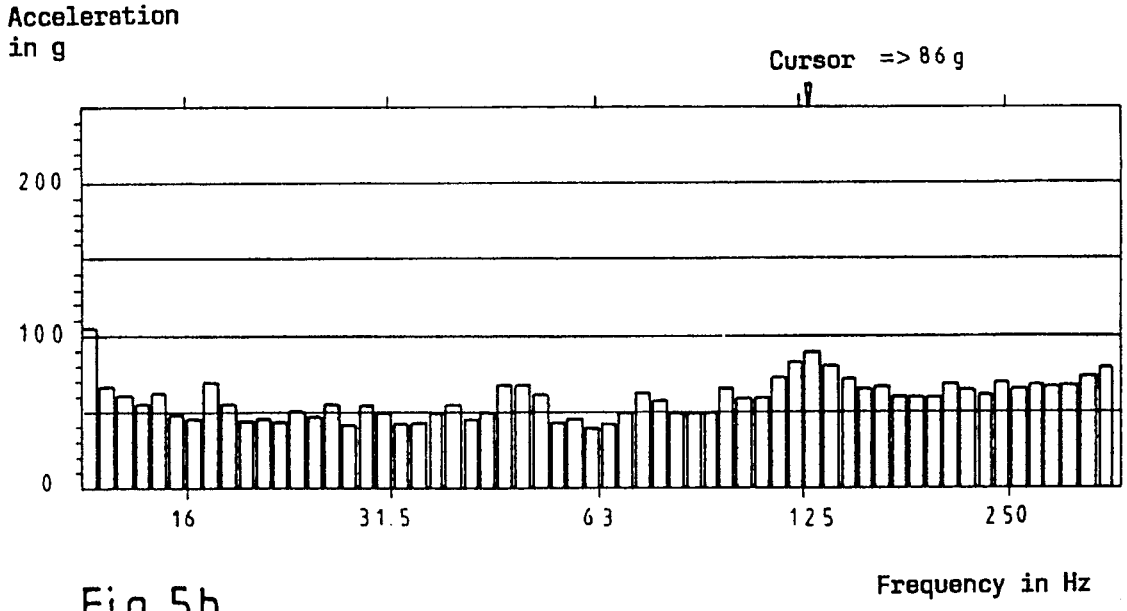
FIG. 5*b* shows a vibration spectrum, in which the vibration amplitude is illustrated in g (acceleration due to gravity) in dependence upon the frequency in Hz of the racket-arm system with damper.

It can also be gathered from the FIGS. 5*a* and *b* that, in the damped system (FIG. 5*b*), the frame vibrations which occur around 125 Hz, are clearly reduced.

As already mentioned, the addition material can be mounted at various points on the racket 100. Especially favorable, however, is the mounting generally where, during the execution of the stroke, the vibration-wise deflection of the racket is substantial. In this case the addition material can be comprised of different materials. However, it has to possess an adequate density so as to make it possible to accommodate sufficient material within a restricted space. An addition material weighing approximately 10 g has proved itself.

Altogether, by means of the invention, a sports racket results which is distinguished by an enhanced feel for the ball and which makes an improved control of the ball possible and which clearly reduces the strain on the hand and the arm of the player.

What is claimed is:

1. A sports racket with strung netting, comprising a frame which delimits a striking surface formed by strings tautly strung in the frame, a handle with a longitudinal axis as well as a connection region connecting the handle with the frame, wherein, within the connection region a resiliently mounted filler material is fitted, wherein the filler material is configured so as to be tube-shaped and disposed at a right angle to the longitudinal axis of the handle and so as to lie in the plane defined by the striking surface.

2. The sports racket according to claim 1, wherein the filler material is disposed within the connection region between the frame and the handle.

3. The sports racket according to claim 2, wherein the filler material is embedded in a resilient damping material.

4. The sports racket according to claim 3, wherein the filler material and the damping material are embedded in a vibration eliminating chamber.

5. The sports racket according to claim 4, wherein the vibration eliminating chamber is connected to the frame.

6. The sports racket according to either claim 4 or 5, wherein the vibration eliminating chamber is comprised of a non-flexible material.

7. The sports racket according to claim 6, wherein the filler material, in conjunction with the damping material and the vibration eliminating chamber, can be fitted in the form of a separate component part refitable to commercially available rackets.

8. The sports racket according to claim 3, wherein a foamed plastic or cellular rubber is employed as the damping material.

9. The sports racket according to claim 8, wherein the damping material possesses an elastic recovery behavior greater than 7 ms.

10. The sports racket according to claim 9, wherein the filler material possesses a bulk of approximately 10 g.

11. The sports racket according to any of claims 3 through 5, or 8 through 10, wherein the damping material is connected to the frame.

12. The sports racket according to claim 11, wherein the damping material is rigidly connected with the filler material.

13. The sports racket according to claim 12, wherein the filler material, in conjunction with the damping material and the vibration eliminating chamber, can be fitted in the form of a separate component part refitable to commercially available rackets.

14. The sports racket according to claim 13, wherein the filler material is comprised of a material possessing a density greater than 12 g/cm$^2$.

15. A sports racket with strung netting, comprising a frame which delimits a striking surface formed by strings tautly strung in the frame, a handle with a longitudinal axis as well as a connection region connecting the handle with the frame, wherein, within the connection region a resiliently mounted filler material is fitted, wherein the filler material is configured so as to be tube-shaped and disposed at a right angle to the longitudinal axis of the handle and so as to lie in the plane defined by the striking surface, wherein the filler material is embedded in a resilient damping material.

16. The sports racket according to claim 15, wherein the filler material and the damping material are embedded in a vibration eliminating chamber.

17. The sports racket according to claim 16, wherein the filler material, in conjunction with the damping material and the vibration eliminating chamber, can be fitted in the form of a separate component part refitable to commercially available rackets.

18. The sports racket according to claim 15, wherein a foamed plastic or cellular rubber is employed as the damping material.

19. The sports racket according to claim 15, wherein the damping material possesses an elastic recovery behavior greater than 7 ms.

20. The sports racket according to claim 15, wherein the damping material is rigidly connected with the filler material.

21. A sports racket with strung netting comprising a frame which delimits a striking surface formed by strings tautly strung in the frame, a handle with a longitudinal axis as well as a connection region connecting the handle with the frame, wherein, within the connection region a resiliently mounted filler material is fitted, wherein the filler material is configured so as to be tube-shaped and disposed at a right angle to the longitudinal axis of the handle and so as to lie in the plane defined by the striking surface;

the filler material is disposed within the region of the connection region between frame and handle;

the filler material is embedded in a resilient damping material;

the filler material and the damping material are embedded in a vibration eliminating chamber;

the vibration eliminating chamber is connected to the frame;

the vibration eliminating chamber is comprised of a non-flexible material;

the filler material, in conjunction with the damping material and the vibration eliminating chamber, can be fitted in the form of a separate component part refitable to commercially available rackets;

a foamed plastic or cellular rubber is employed as the damping material;

the damping material possesses an elastic recovery behavior greater than 7 ms;

the filler material possesses a bulk of approximately 10 g;

the damping material is connected to the frame;

the damping material is rigidly connected with the filler material; and the filler material is comprised of a material possessing a density greater than 12 g/cm$^2$.

* * * * *